US006112166A

United States Patent [19]

Joosten

[11] Patent Number: 6,112,166

[45] **Date of Patent: *Aug. 29, 2000**

[54] PORTABLE MEASUREMENT TOOL AND METHOD FOR ESCALATORS AND MOVING WALKS

[75] Inventor: Drew Joosten, El Cajon, Calif.

[73] Assignee: Digimetrix, Inc., Santee, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/962,247

[22] Filed: Oct. 31, 1997

[51] Int. Cl.[7] ..... B66B 29/00

[52] U.S. Cl. ..... 702/185; 198/323

[58] Field of Search ..... 702/185, 141–142, 702/145, 149; 364/184, 187, 188; 198/322, 323, 341.08, 341.09; 340/531, 532

[56] References Cited

U.S. PATENT DOCUMENTS

| | | | |
|---|---|---|---|
| 4,600,865 | 7/1986 | Caputo . | |
| 4,664,247 | 5/1987 | Wolf et al. . | |
| 4,815,319 | 3/1989 | Clement et al. . | |
| 5,072,820 | 12/1991 | Steffen et al. | 198/323 |
| 5,083,653 | 1/1992 | Sakata et al. | 198/323 |
| 5,099,977 | 3/1992 | Hirose et al. | 198/323 |
| 5,135,097 | 8/1992 | Saito et al. . | |
| 5,186,300 | 2/1993 | Zaharia | 198/323 |
| 5,236,075 | 8/1993 | Bartmann . | |
| 5,295,567 | 3/1994 | Zaharia et al. | 198/323 |
| 5,435,543 | 7/1995 | Lehmann . | |
| 5,467,658 | 11/1995 | Buckalew et al. . | |
| 5,526,256 | 6/1996 | Sakata et al. | 364/184 |
| 5,601,178 | 2/1997 | Zaharia et al. | 198/323 |
| 5,708,416 | 1/1998 | Zaharia et al. | 340/531 |

*Primary Examiner*—Marc S. Hoff
*Assistant Examiner*—Bryan Bui
*Attorney, Agent, or Firm*—Jones, Tullar & Cooper, P.C.

[57] ABSTRACT

A non-invasive, portable measuring and recording apparatus and method to detect, analyze, and report the operating velocity, deceleration, jerk, and stopping distance of escalators, moving walks, and other conveyor systems. The apparatus includes motion sensors to externally measure the motion of the escalator and to generate electrical pulses encoding those measurements, a stop trigger to activate the Emergency Stop Switch and to coordinate the resulting activation of the escalator's brake system with these motion measurements, a wireless switch sensor to detect the de-energizing/energizing of the escalator safety circuit, or brake solenoid as an alternative way to coordinate the activation of the escalator brake system with these motion measurements, electronic circuitry to collect and process these pulses, and a computer software program to display, analyze, save, recall, and print test data. Measurements may be made from either landing with the escalator running in either direction. The motion sensors are applied against the external surfaces of the steps, treadboards, pallets, treadway or conveyor mechanism and handrails. Deceleration, jerk and stopping distance are measured by either inducing a stop with the stop trigger or detecting a stopping action with the wireless switch sensor. The apparatus can measure the steps and both handrails simultaneously. Test results may be reported against a Safety Code or other standard, and multiple test runs may be combined into a single test report.

20 Claims, 4 Drawing Sheets

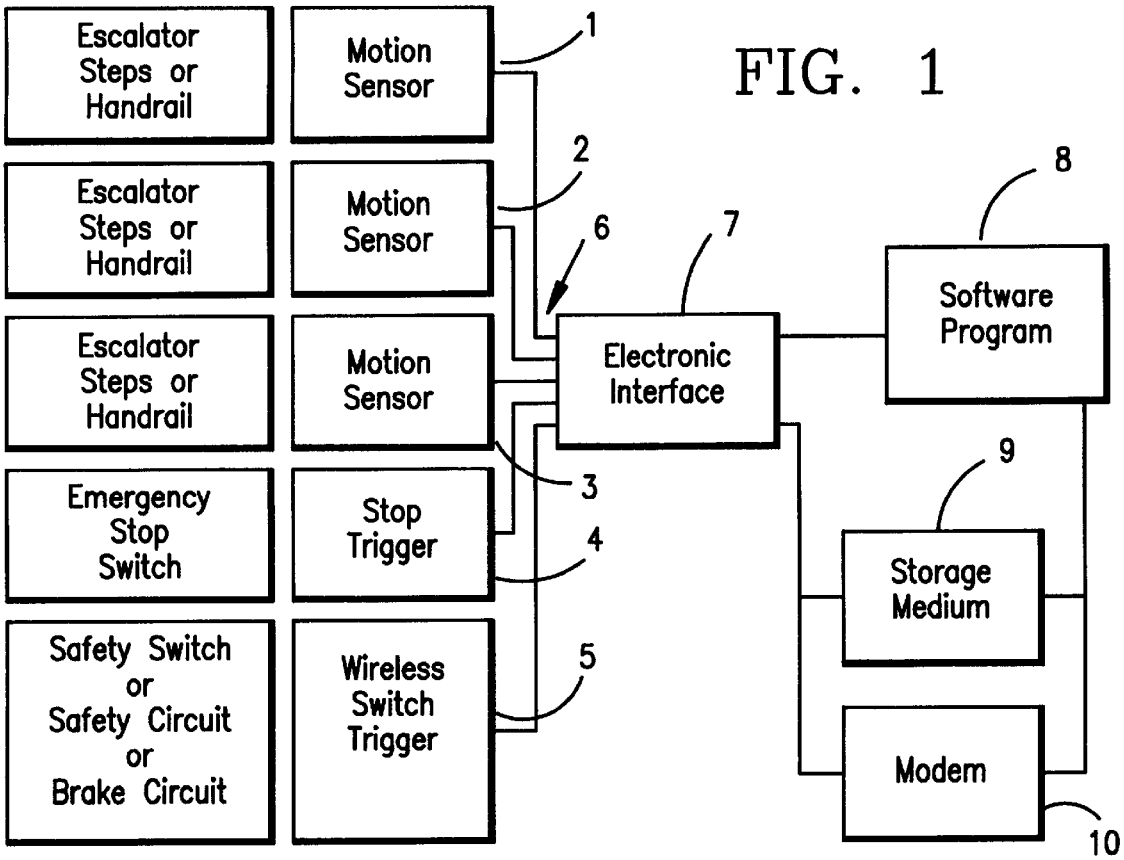
FIG. 1
FIG. 2
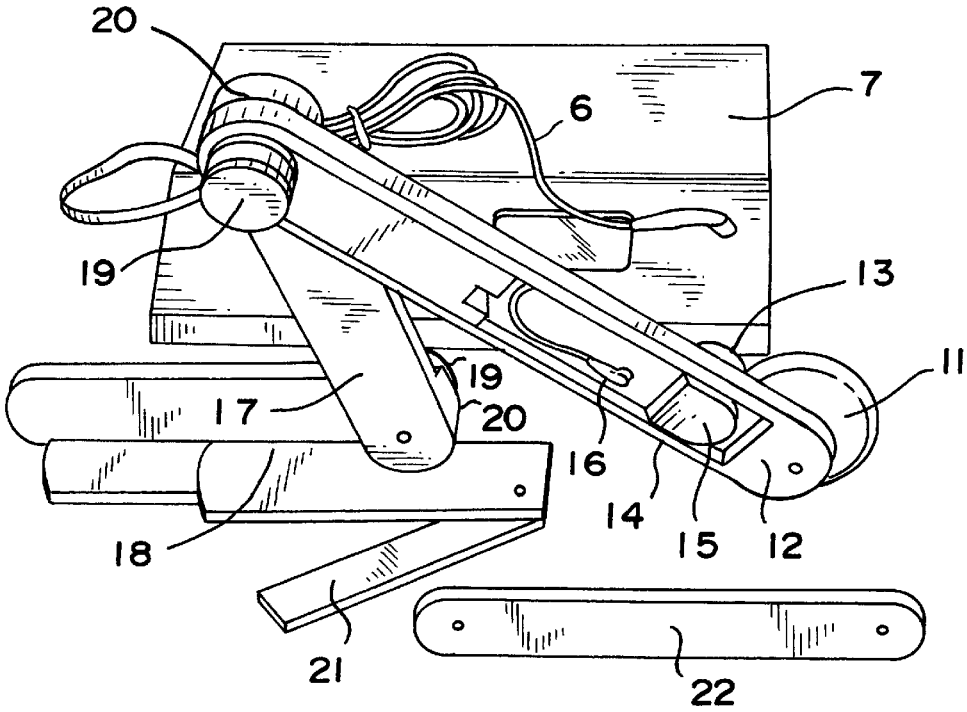

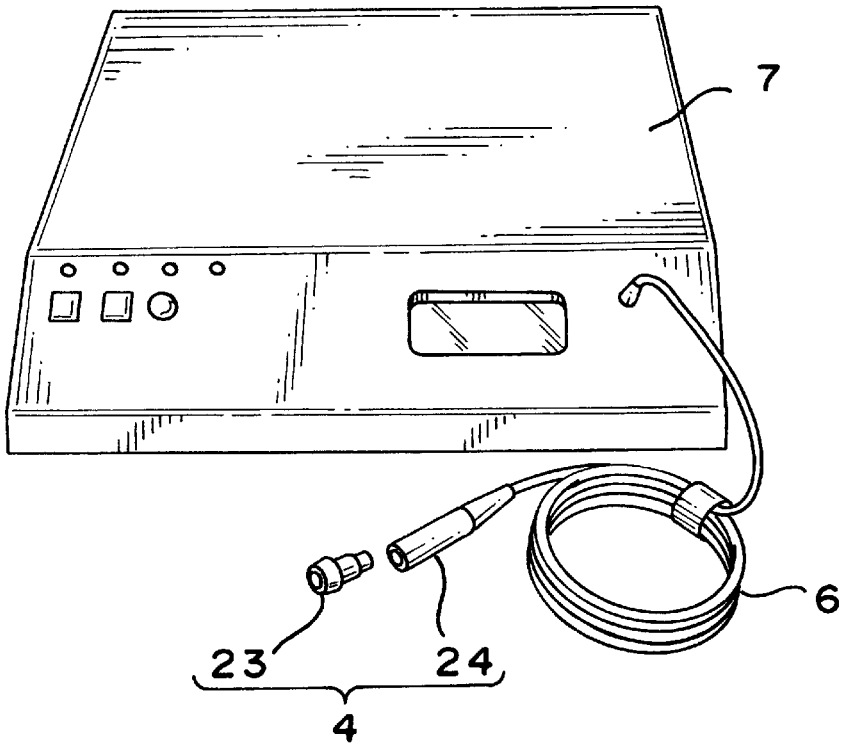
FIG. 3
FIG. 4
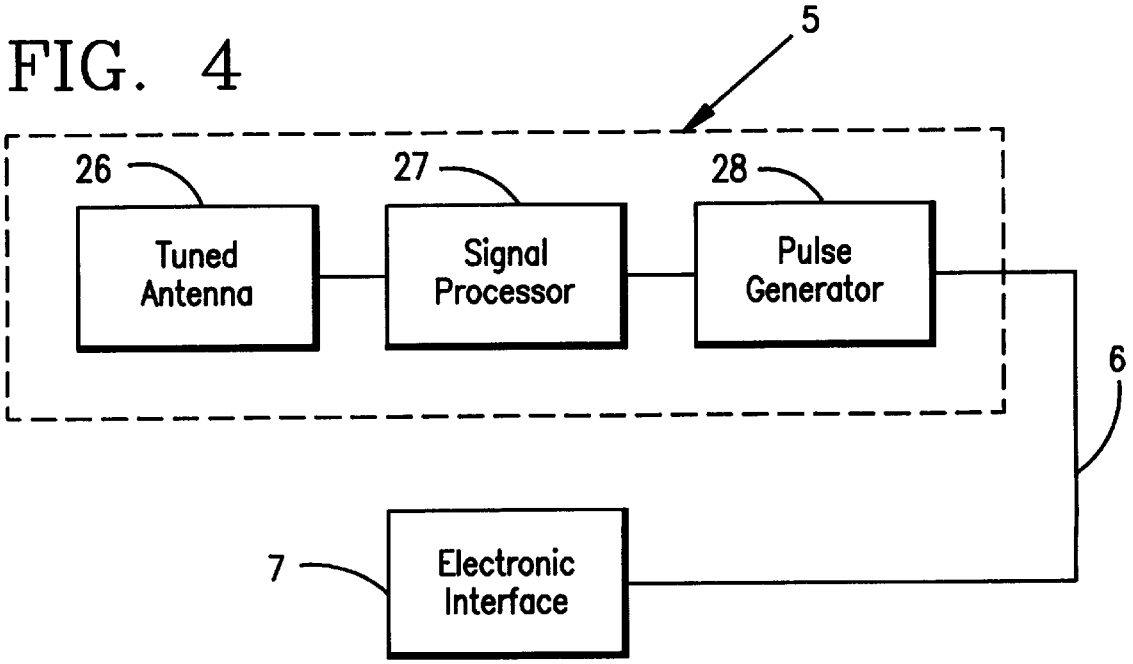

PORTABLE MEASUREMENT TOOL AND METHOD FOR ESCALATORS AND MOVING WALKS

BACKGROUND OF THE INVENTION

1. Field of Invention

The present invention relates in general to test and measurement equipment, and more specifically to an apparatus and method for measuring, recording, analyzing and reporting the operating velocity, deceleration, jerk, that is rate of change of change, and stopping distance of the steps, treadboards, pallets, treadway, or conveyor mechanism and the moving handrails of an escalator, moving walk, or other conveyor mechanism and in particular to such an apparatus which may form a portable measurement tool.

2. General Background

Escalators and moving walks are equipped with electromechanical braking systems that bring the steps and handrails of the escalator to a rapid stop whenever any one of the numerous safety devices in the escalator is activated. Excessively rapid deceleration causes riders to be thrown forward, possibly resulting in injury. Slow or delayed deceleration results in prolonged stopping distances which can compound injuries and damage resulting from entrapments between the moving and stationary elements of the escalator, including the comb sections located at each landing. US Consumer Product Safety Commission statistics indicate that there are thousands of reported escalator and moving walk injuries annually. The severity of injury and damage resulting from virtually all escalator accidents are affected by the rate of deceleration and the stopping distance of the escalator. In most jurisdictions, the maximum deceleration rate and the maximum stopping distance are regulated by a legally mandated Safety Code. Most jurisdictions employ or contract with inspectors to ensure Safety Code compliance.

One way of measuring step velocity is by manually applying a hand held tachometer to the handrails and manually recording its velocity. Then riding the escalator or moving walk and applying a tachometer to the balustrade to ascertain step velocity, and manually recording the results. These techniques are imprecise, prone to recording errors, difficult to duplicate precisely, and do not provide data related to stopping distances or deceleration.

Another known procedure is that of initiating a braking action by manually tripping a safety device, e.g., emergency stop switch, when a particular step, treadboard, or pallet or point on a treadway or conveyor mechanism passes a predetermined point, e.g., a mark on the skirt panel of the escalator, a skirt safety switch or a missing step detector, and then manually measuring the distance traveled using a rule or tape measure. These techniques are also imprecise, prone to recording errors, difficult to duplicate precisely, and do not actually evaluate the action of the braking system, i.e. discern differences between coasting and active brake retardation. Nor do they provide sufficient data to calculate the actual rate of deceleration or jerk. The inability to evaluate the action of the braking system means that such techniques fail to address the actual Safety Code limitations on maximum deceleration rate which is expressed as a formula, e.g, 3 $ft/sec^2$ or 0.9 $m/s^2$ Deceleration can also be measured and recorded by using ad hoc test rigs consisting of a rotary encoder device which is applied to the motor shaft or drive shaft of an escalator or moving walk and a circuit monitor connected to the safety circuit. Test data is recorded either with a paper chart recorder or using a personal computer. These techniques correlate the initiation of braking action with velocity data, and support deceleration analysis. However, they are invasive and time consuming to set up, often taking hours to complete. They require that the escalator be barricaded against public access, that power be removed from the escalator, that access panels, landing plates and sometimes steps be removed, that encoders be mounted on the motor or drive shaft, and that circuit probes be connected to the safety or brake circuit.

Then too, velocity and deceleration measurements may be obtained using accelerometers placed on a moving step or handrail. This technique supports deceleration analysis. However, because it fails to account for the initiating event of the braking action, the analysis cannot detect delays in the activation of the brake mechanism. Such delays can exacerbate injuries, and may constitute a violation of Safety Code requirements.

It would therefore be desirable to have measurement equipment for measuring velocity, deceleration, jerk and stopping distances of escalator steps, treadboards, pallets, treadway or conveyor mechanism and the moving handrails of an escalator, moving walk or other conveyor mechanism, which is free of the deficiencies noted above.

SUMMARY OF THE INVENTION

It is, therefore, an object of the present invention to provide such measurement apparatus, and in particular to provide such an apparatus which is in the form of a non-invasive portable tool.

It is a related object of the present invention to provide a method of measuring, recording, analyzing and reporting the operating velocity, deceleration, jerk and stopping distance of the steps, treadboards, pallets, treadway, or conveyor mechanism and the moving handrails of an escalator and the like.

A non-invasive, portable measuring and recording apparatus and method are described with respect to parameters such as operating velocity, deceleration, jerk and stopping distance of the steps, treadboards, pallets, treadway or conveyor mechanism and the support hydraulics of escalators measured, recorded, analyzed, and reported.

Motion sensors are placed free standing on the escalator landing at either the entrance or exit, applied against the moving steps and handrails, and connected via an electronic interface to an IBM PC compatible computer running the MS Windows based ESCalibrator software program. Step and handrail velocity are measured by the sensors and recorded in the software along with identifying information about the escalator being measured. Activation of the escalator brake system is initiated by applying the stop trigger to the escalator's emergency stop switch. Alternatively the initiation of a braking action may be detected wirelessly by placing a wireless switch sensor in the proximity of a safety switch, safety circuit or brake circuit and detecting the RF emission associated with an on/off transition of a switch in the circuit. The trigger event is recorded in the software along with the measurements of step and handrail motion. The deceleration characteristics of the steps and handrail are then displayed graphically and in tabular form on the computer. The software program allows subsequent analysis of the deceleration data to determine the average and maximum deceleration and jerk over the entire stopping sequence or for selectable subset of the stopping sequence. Velocity and deceleration reports display one or multiple test runs and may be printed via either color or monochrome printer.

BRIEF DESCRIPTION OF THE DRAWINGS

FIG. 1 which is a representative block diagram illustrating the elements of the system.

FIG. 2 which illustrates the initial embodiment of the motion sensor and articulated base and arm assemble comprising the present invention.

FIG. 3 which illustrates one embodiment of a stop trigger.

FIG. 4 which illustrates one embodiment of a wireless switch sensor.

DETAILED DESCRIPTION OF THE PREFERRED EMBODIMENT

Figure 5:
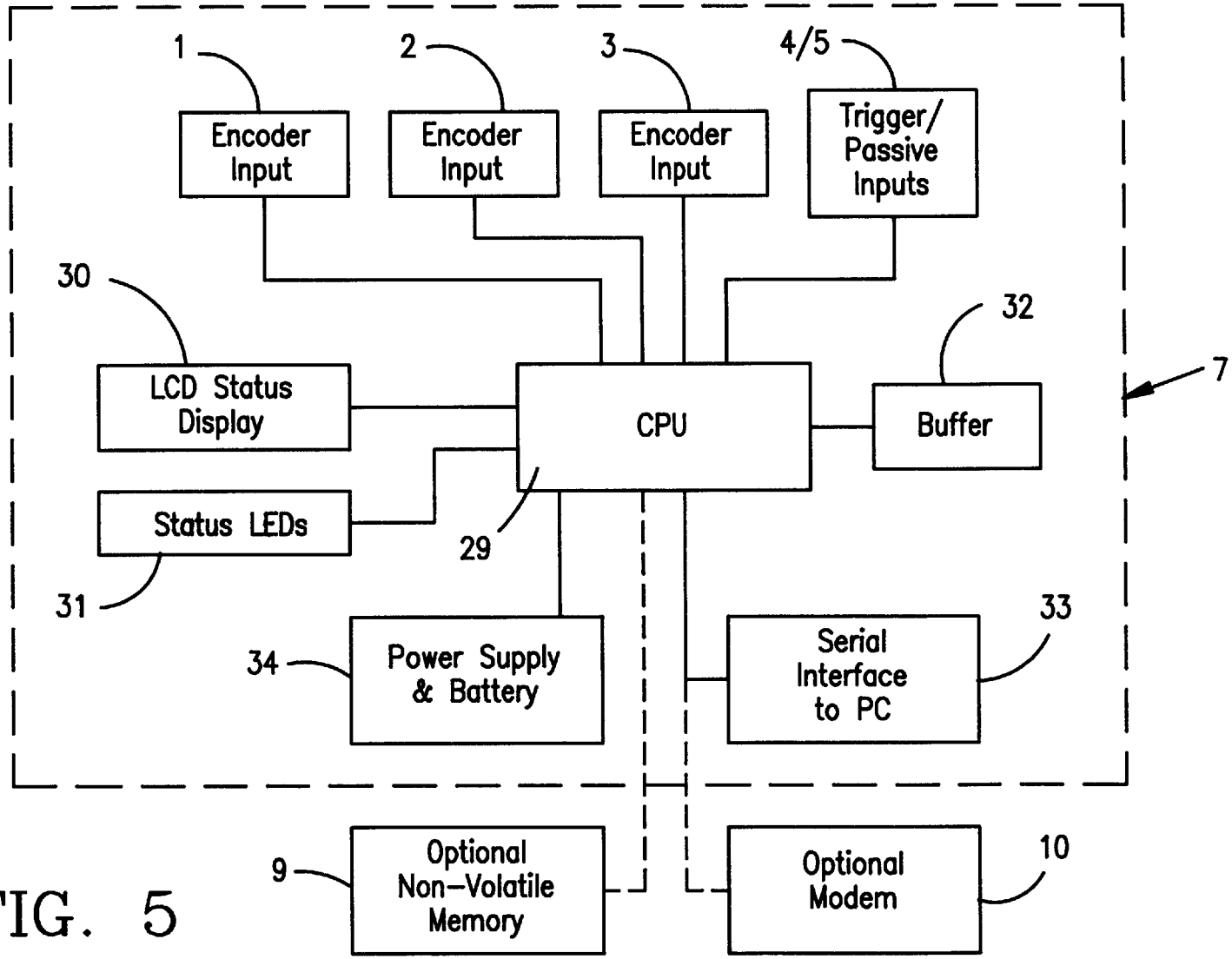
FIG. 5 which is a representative block diagram of the electronic interface.

FIG. 1 is a block diagram showing the principle elements of the present invention and the relationship of those elements to the escalator being evaluated. Up to three motion sensors 1, 2, 3 are placed in contact with the exterior of the escalator steps, treadboards, pallets, treadway conveyor mechanism, or handrail. The motion sensors are free standing, require no attachment and are held in contact by the weight of the sensor support assembly. The motion sensors generate encoded motion measurements as electrical pulses which are transmitted to an electronic interface 7. To stop the escalator, a stop trigger 4 is applied rapidly against the escalator emergency stop switch. This action simultaneously activates the escalator brake system and generates an electrical pulse at the precise time of activation. Alternatively, the independent activation of the escalator brake system may be passively detected using a wireless switch sensor 5 that detects the activation of a safety device, brake solenoid, or other brake related circuit. This device is placed in the immediate vicinity of the switch or circuit and generates an electrical pulse at the precise time of activation. Sensor and trigger pulses are transmitted to the electronic interface 7 either by way of hardwire cables, or wirelessly by way of infrared or RF transceivers. The electronic interface 7 scans the sensor data and the stop trigger data, then transmits that data to the software program 8 running on an IBM compatible laptop computer, for example. Alternatively, the data may be either temporarily held at the electronic interface in a storage medium 9 such as a hard drive or nonvolatile RAM for subsequent down loading transfer to the software program at a future time, or transmitted via modem 10 to a remote location. The software program 8 receives, displays, stores, recalls, and analyzes the data and generates hard copy reports of the data and the analysis thereof.

FIG. 2 illustrates the initial embodiment of the motion sensor 1, 2 or 3 in combination with an articulated base and arm assembly. A contact roller 11 is attached to a head assembly arm 12 which is placed in physical contact with the escalator steps, treadboards pallets, treadway or conveyor mechanism or handrail to translate linear motion into rotary motion. A counter wheel 13 is mounted on the axle of a pulse counter 14, which extends through the head assembly arm 12, and transfers the rotation of the contact roller 11 to a pulse counter 15. Constant, uniform contact is maintained between the contact roller 11 and the counter wheel 13 by means of a tension spring 16. The pulse counter 15 transmits measurement data to the electronic interface 7 via the hardwire cable or transciever 6. The pulse counter 15 is mounted in the head assembly arm 12 and protected by a cover plate 22. The head assembly arm 12, the extension arm 17, and the base 18 are connected to each other by adjustable friction joints consisting of a tightening bolt 19 and a rubber washer 20 inserted between the two arms such that the friction can be reduced to allow the arms to be positioned to maintain optimal contact between the contact roller and the escalator. The base 18 is stabilized laterally by a pair of adjustable balance wings 21 that pivot out from under the base.

FIG. 3 illustrates one embodiment of the stop trigger 4 (FIG. 1) that can be used to initiate the activation of the escalator brake system and simultaneously note the precise occurrence of that event in time. It consists of a momentary button 23 enclosed in handle shell 24 and connected to the electronic interface 7 by way of the hardwire cable 6.

FIG. 4 illustrates one embodiment of the device 5 to passively detect the precise activation of a switch used to initiate the activation of the brake system, or the activation of the brake solenoid of the escalator. It is a wireless switch sensor which detects the RF emission associated with the on/off transition of an electrical switch. It includes a tuned antenna 26, a signal processing and filtering circuit 27, and a single pulse generator 28 that conveys the precise occurrence of time of the activation to the electronic interface 7 by way of the hardwire cable 6.

FIG. 5 is a representative electrical schematic diagram illustrating in greater detail the embodiment of the electronic interface device 7 for obtaining and processing sensor and trigger signals. It includes three sensor input channels associated with the sensors 1, 2 and 3, and a trigger input channel associated with either an active stop trigger 4 or a wireless switch sensor device 5. A central processing unit 29 scans the input channels to collect pulse data from the sensors, converts those pulses to time stamped distance measurements, and buffers this data in buffer 32 until it is transmitted to the software program via a serial communications link 33. Alternatively, the data could be transmitted via modem 10 to a remote personal computer, or it may be stored in a storage medium 9 such as a hard drive or non-volitile RAM for subsequent downloading to the software program 8.

A display 30 is provided which gives the status of the input, the type of sensor and its recalibration date, and also the type of trigger being used. The status LEDs 31 indicate whether or not there is electrical continuity with each input jack. Also provided are a 110 VAC Power Supply, a working battery, and battery recharging recircuitry 34.

Figure 6:
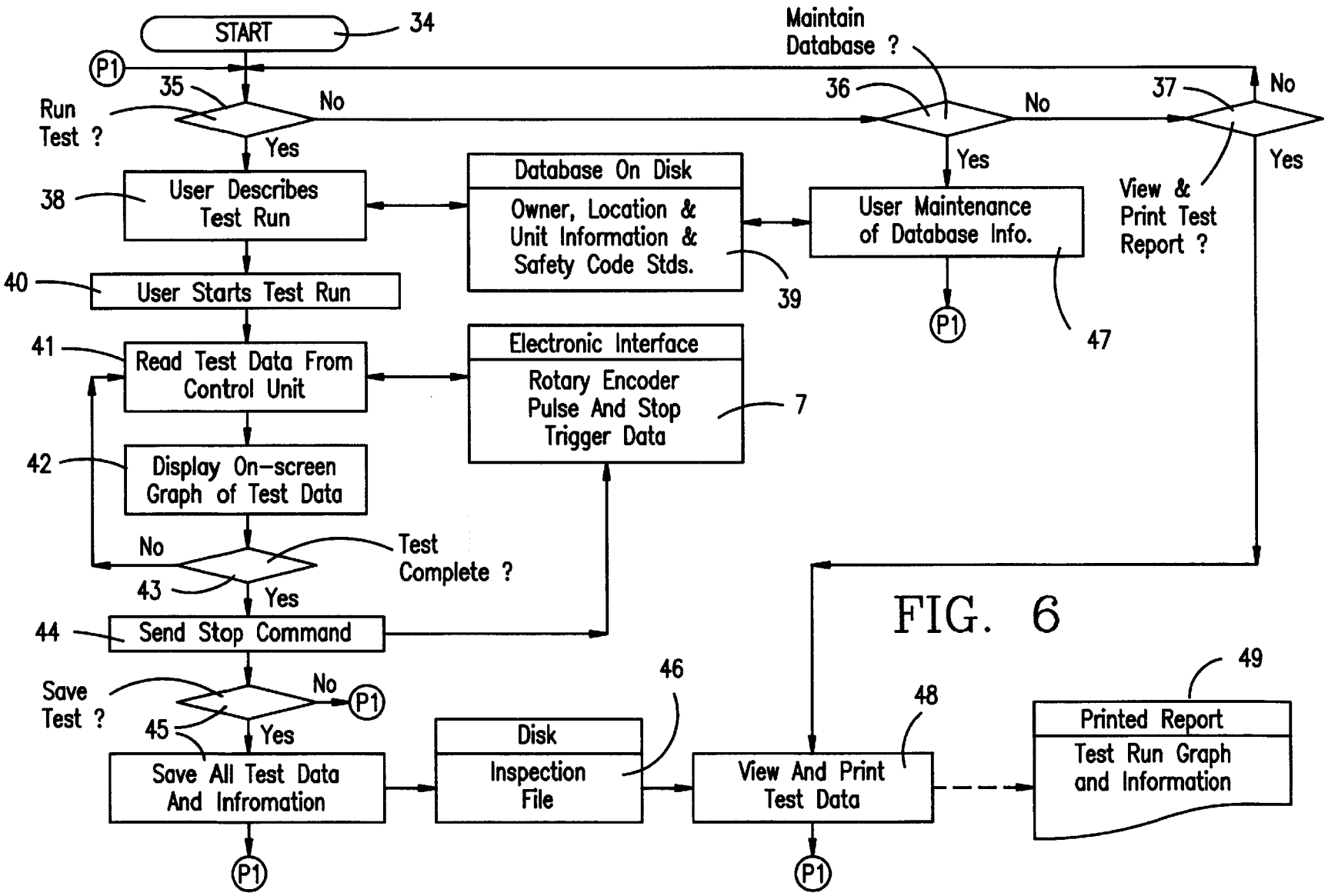
FIG. 6 which is a software control flow chart of the preferred embodiment of the invention.

The Software Program which receives the rotary encoder and stop trigger information from the electronic interface 7 is shown via the flow chart in FIG. 6. The program displays this data in a graphical and numerical on-screen presentation, and saves this data to non-volatile disk memory. All user commands to the program are via the pointer device or by using combinations of keys on an IBM PC compatible computer.

Upon Start 34, the program offers the user the choices of Run Test 35, Maintain Database 36, and View and Print Test Reports 37.

If the user chooses to run a test, the user will identify the Owner and Location of the equipment being tested (escalator, for example), and a description of the unit of equipment at 38. This information is stored in a database on a non-volatile disk memory 39, and in an Inspection File 46 on non-volatile disk memory. The user starts the test by a command to the program 40.

The program transmits a start command to the electronic interface 7, and the Electron Interface initiates the transfer of Rotary Encoder and Stop Trigger data to the program 41. The program displays this data on a computer screen 42.

If the Rotary Encoder data should indicate that there is no motion for the Braking Test, or the user commands the program to stop recording 43 for either the Braking or Speed Test, the program sends a stop command to the electronic interface 44, and the user may then save the test 45 in the Inspection File 46. The user may run and store multiple tests for multiple units of equipment in the same Inspection File.

If the user chooses to Maintain the Database 36 containing detailed information about the Owner, Location and Unit(s) being tested, the user is provided dedicated windows for this purpose 47, and the program saves this information in the Database on Disk 39.

If the user chooses to View and Print Test Reports 37, the user selects from a list of existing Inspection Files 46 on non-volatile disk memory. The user is then provided a "browser" window from which to select the desired Unit, and the desired Braking or Speed test. The user then views the Test Data on-screen 48, and may choose to generate a printed report of the Test Graph and related Information 49 (Owner, Location, and Unit description). The user may also choose to include multiple Test results on the same report to provide side-by-side comparisons of the measured data.

The foregoing describes the preferred embodiment of the apparatus and the manner of operation for measuring, recording and reporting the velocity, deceleration, jerk, and stopping distance of escalators, moving walks, and other conveyor mechanisms. While it is recognized that modifications, substitutions and equivalents will readily occur to those skilled in the art, it should be understood that these disclosures are to be considered illustrative of the principles of the invention, that there is no intent to limit the invention by these disclosures, but rather it is intended to cover all alternate constructions and applications falling within the spirit and scope of the invention including alternate motion detection methods such as accelerometers, alternate triggering methods, alternate methods to passively detect the activation of the brake system, alternative attachment methods, and alternate recording and display medium. Further, the device could be permanently mounted into an escalator.

I claim:

1. A non-invasive, portable apparatus for measuring, recording and reporting the velocity, deceleration, jerk, and stopping distance of escalators, moving walks, and other conveyor mechanisms, the escalators, moving walks, and other conveyor mechanisms having a braking system, comprising:

at least one motion sensor for detecting step, treadboard, pallet, treadway, conveyor mechanism; said at least one motion sensor generating encoded motion measurements as electrical pulses;

a trigger mechanism which is used to initiate activation of the braking system of the conveyor mechanism and generates an electric pulse at the precise time of activation;

electronic circuitry to receive, coordinate in time, process and buffer data from said at least one motion sensor, and said trigger mechanism, and output data representative thereof; and data processing means to receive, store and recall the output from said electronic circuitry, and to analyze and present the velocity, deceleration, jerk, and distance traveled data accumulated from said at least one motion sensor and said trigger mechanism.

2. The non-invasive, portable apparatus as defined in claim 1, further comprising:

a framework to support each motion sensor, including biasing means for biasing the sensor against the exterior surface of steps, treadboard, pallets, treadway conveyor mechanism or handrails of conveyor mechanisms.

3. The non-invasive, portable apparatus as defined in claim 2, wherein each said motion sensor includes an articulated base, an arm assembly mounted to said articulated base, a contact roller attached to said arm assembly, a pulse counter connected to said contact roller for converting roller rotation to pulses, and means for connecting said motion sensor to said electronic circuitry.

4. The non-invasive, portable apparatus as defined in claim 3, wherein said articulated base includes said biasing means.

5. The non-invasive, portable apparatus as defined in claim 1, wherein said trigger mechanism includes a momentary pushbutton and a handle shell within which said momentary pushbutton is housed, said momentary pushbutton being connected to said electronic circuitry such that when the said momentary pushbutton is activated a timing pulse is transmitted to said electronic circuitry.

6. The non-invasive, portable apparatus as defined in claim 1, wherein said electronic circuitry includes a central processing unit which receives data from said at least one motion sensor and said trigger mechanism, a serial interface link and a buffer for buffering said data until it is transmitted to said data processing means.

7. A method for measuring, analyzing, recording and reporting the velocity, deceleration, jerk, and travel distance of the steps, treadboard, pallets, treadway, conveyer mechanism, or handrails of escalators, moving walks, and conveyor mechanisms, comprising the steps of:

applying at least one motion sensor against the exterior surface of the steps, treadboard, pallets, treadway, conveyor mechanism or handrails of the conveyor mechanism and generating thereby encoded motion measurements as electrical pulses;

triggering the initiation of a braking action of the conveyor mechanism from the exterior thereof by rapidly applying the trigger mechanism to an exterior stop switch of the conveyor mechanism in such a fashion as to activate the stop switch and simultaneously cause the trigger mechanism to generate an electric timing pulse to the electronic circuitry;

using electronic circuitry to collect, process, buffer, and transmit encoded motion measurements and triggered initiation data;

using a computer to receive, store and recall encoded motion measurements and the triggered initiation data;

using data processing means to analyze and present the velocity, deceleration, jerk, and distance traveled data accumulated from the receive data; and comparing and reporting deceleration and travel distance data against established standards and safety limits.

8. The method as defined in claim 7, wherein the computer is a personal computer.

9. The method as defined in claim 8, wherein said data processing means comprises a computer program.

10. The method as defined in claim 7, wherein said data processing means comprises a computer program.

11. A non-invasive, portable apparatus for measuring, recording and reporting the velocity, deceleration, jerk, and stop distance of escaltors, moving walks, and other conveyor mechanism, the escalators, moving walks, and other conveyor mechanisms having a braking system, comprising:

at least one motion sensor for detecting step, treadboard, pallet, treadway, conveyor mechanism or handrail motion of a conveyor mechanism; said at least one motion sensor generating encoded motion measurements as electrical pulses;

a wireless switch sensor which passively detects and marks in time the precise activation of a circuit used to initiate the activation of the braking system;

electric circuitry to receive, coordinate in time, process and buffer data from said at least one motion sensor and said wireless switch sensor, and output data representative thereof; and data processing means to receive, store and recall the output from said electronic circuitry, and to analyze and present the velocity, deceleration, jerk and distance traveled data accumulated from said at least one motion sensor and said wireless switch sensor.

12. The non-invasive, portable apparatus as defined in claim 11, wherein said wireless switch sensor includes a tuned antenna, a signal processing and filtering circuit and a single pulse generator.

13. The non-invasive, portable apparatus as defined in claim 11, further comprising;

a framework to support each motion sensor, including biasing means for biasing the sensor against the exterior surface of steps, treadboard, pallets, treadway conveyor mechanism or handrails of conveyor mechanisms.

14. The non-invasive, portable apparatus as defined in claim 13, wherein each said motion sensor includes an articulated base, and arm assembly mounted to said articulated base, a contact roller attached to said arm assembly, a pulse counter connected to said contact roller for converting roller rotation to electronic pulses, and means for connecting said motion sensor to said electronic circuitry.

15. The non-invasive, portable apparatus as defined in claim 14, wherein said articulated base includes said biasing means.

16. The non-invasive, portable apparatus as defined in claim 11, wherein said electronic circuitry includes a central processing unit which receives data from said at least one motion sensor and said wireless switch sensor, a serial interface link and a buffer for buffering said data until it is transmitted to said data processing means.

17. A method for measuring, analyzing, recording and reporting the velocity, deceleration, jerk, and travel distance of the steps, treadboard, pallets, treadway, conveyor mechanism, or handrails of escalators, moving walks, and conveyor mechanisms, comprising the steps of:

applying at least one motion sensor against the exterior surface of the steps, treadboards, pallets, treadway, conveyor mechanism or handrails of the conveyor mechanism and thereby generating encoded motion measurements as electrical pulses;

passively detecting and marking in time the commencement of a braking action of the conveyor mechanism caused by the activation of a safety switch, brake solenoid, or other related circuit of the conveyor mechanism without a hardwire connection to that circuit;

using electronic circuitry to collect, process, buffer, and transmit encoded motion measurements and braking system activation signals;

using a computer to receive store and recall encoded motion measurements and the passively detected commencement data;

using data processing means to analyze and present the velocity, deceleration, jerk, and distance traveled data accumulated from the received data; and comparing and reporting deceleration and travel distance data against established standards and safety limits.

18. The method as defined in claim 17, wherein the computer is a personal computer.

19. The method as defined in claim 18, wherein said data processing means comprises a computer program.

20. The method as defined in claim 17, wherein said data processing means comprises a computer program.

* * * * *